United States Patent [19]

Tanaka et al.

[11] 4,191,877

[45] Mar. 4, 1980

[54] MICROWAVE OVEN EQUIPPED WITH ELECTRIC HEATING ARRANGEMENT

[75] Inventors: Junzo Tanaka, Fujiidera; Shigeru Kusunoki, Yamatokoriyama; Hirofumi Yoshimura, Nara, all of Japan

[73] Assignee: Matsushita Electric Industrial Co., Ltd., Osaka, Japan

[21] Appl. No.: 893,312

[22] Filed: Apr. 4, 1978

[30] Foreign Application Priority Data

Jul. 11, 1977 [JP] Japan ..... 52-83182

[51] Int. Cl.[2] ..... H05B 9/06

[52] U.S. Cl. ..... 219/10.55 B; 219/10.55 D; 219/10.55 R; 219/10.55 E

[58] Field of Search ..... 219/10.55 E, 10.55 D, 219/10.55 C, 10.55 F, 10.55 B, 10.55 R

[56] References Cited

U.S. PATENT DOCUMENTS

| | | | |
|---|---|---|---|
| 3,081,392 | 3/1963 | Warner | 219/10.55 E |
| 3,182,164 | 5/1965 | Ironfield | 219/10.55 D |
| 3,196,243 | 7/1965 | Schall | 219/10.55 D |
| 3,320,396 | 5/1967 | Boehm | 219/10.55 E |
| 3,502,839 | 3/1970 | Tibbs | 319/10.55 D |
| 3,584,177 | 6/1971 | Bucksbaum | 219/10.55 D |
| 3,668,357 | 6/1972 | Kobayashi | 219/10.55 D |
| 3,809,843 | 5/1974 | Takayama | 219/10.55 D |
| 3,985,993 | 10/1976 | Imberg et al. | 219/10.55 D |

*Primary Examiner*—Bruce A. Reynolds
*Assistant Examiner*—Philip H. Leung
*Attorney, Agent, or Firm*—Wenderoth, Lind & Ponack

[57] ABSTRACT

A microwave oven which is provided with an electric heating arrangement for surface browning of an object to be heated which includes a heater portion having a heater surrounded by a sheath and a power supplying base portion enclosed in a metallic cover and having power supplying electrodes for the heater portion, and power feeding section having choke structure for preventing leakage of high frequency waves which is provided in one of the walls defining a heating cavity so as to receive the power supplying base portion in an opening formed in the choke structure, while the sheath is so connected to the metallic cover as to establish good electrical conduction therebetween, so that sealing of high frequency waves is achieved between the heater and choke structure.

11 Claims, 9 Drawing Figures

MICROWAVE OVEN EQUIPPED WITH ELECTRIC HEATING ARRANGEMENT

BACKGROUND OF THE INVENTION

The present invention relates to a high frequency heating apparatus, and more particularly to a microwave oven equipped with an electric heating arrangement for ordinary heating by an electric heater as well as high frequency heating of an object to be heated.

Commonly, in microwave ovens, high frequency oscillator tubes such as magnetrons are generally employed for subjecting food materials which have been placed in a heating cavity or heating chamber to be cooked for a high frequency heating or dielectric heating, while some types of such microwave ovens are further equipped with electric heating arrangements to heat the materials to be cooked in one heating cavity through heating by an ordinary electric heater as well as heating by high frequency waves normally in microwave ranges either simultaneously or independently for formation of surface browning or scorching of the food materials to such an extent as will stimulate one's appetite. Particularly, microwave ovens of the latter type have come into wide use because of their useful features as cooking apparatus that the high cooking speed of microwave ovens is advantageously combined with the ability to form the desirable surface browning on the food materials to be cooked.

Conventionally, the electric heating arrangements incorporated in the known microwave ovens of the above described latter kind are broadly divided into two types, i.e., one type disclosed, for example, in U.S. Pat. No. 3,081,392 and employing a so called "sheathed heater" prepared by enclosing a resistant wire for electrical heating in a metal sheath through insulating material, and the other type proposed, for example, by U.S. Pat. No. 3,196,243 and including an unshielded or exposed infrared heater element. Of these two types, the former has been widely adopted, mainly because of its simple and rigid construction, and high heating efficiency.

While the known microwave ovens of the above described type which employ the sheathed heater for effecting the ordinary electric heating as well as the high frequency heating in one heating cavity have the advantage as described earlier, they have problems related to cleaning of the interior of the heating cavity. More specifically, in the heating cavity normally surrounded by an oven defining structure preferably of double wall construction and having a rectangular cubic space defined by six walls, cleaning of at least one of the six walls is made extremely difficult due to provision of the heater element for the electric heating arrangement on such particular one of the cavity defining walls. In other words, while oil drops, juice, crumbs and the like produced by the food materials during cooking and adhering to the cavity walls tend to soil inner surfaces of all the walls forming the heating cavity, such soiling usually becomes very difficult to remove due to heating and drying by the electric heating device especially at the portion of the particular one wall behind the electric heater element.

Although drawbacks as described above may be overcome by making such heater element readily attachable to or detachable from the particular wall, no countermeasures sufficiently effective for the purpose have been proposed in the prior art arrangement described earlier. More specifically, in U.S. Pat. No. 3,196,243 referred to earlier, several fixing screws are employed as means for securing the heater element to the interior of the heating cavity, which arrangement, however, is not only inconvenient for attaching or detaching such heater element, requiring a particular tool for the purpose, but is accompanied by the possibility of danger in that leakage of microwave energy from a power supplying portion of such heater element tends to be increased due to insufficient securing of the heater element to the interior of the heating cavity arising from wearing out or damage to the securing means through repeated detaching and attaching of such heater element, and thus, an electric heating arrangement having a heater element readily detachable and attachable with negligible high frequency leakage, and fully guaranteed for safety even in case of such high frequency leakage is strongly desired in the art.

SUMMARY OF THE INVENTION

Accordingly, an essential object of the present invention is to provide an electric heating arrangement for use in a microwave oven of a type having one heating cavity wherein ordinary electric heating as well as high frequency heating are effected, in which heating arrangement a heater element is adapted to be readily detachable from and attachable to a power feeding portion of said heating arrangement provided in a wall of the heating cavity.

Another important object of the present invention is to provide an electric heating arrangement of the above described type in which leakage of high frequency energy at the power feeding portion for the heater element is reduced to a negligible level.

A further object of the present invention is to provide an electric heating arrangement of the above described type which is fully guaranteed for safety even in the case of leakage of the high frequency energy due to deterioration in the insulation of the heater element.

A still further object of the present invention is to provide an electric heating arrangement of the above described type in which generation of spark discharge and deterioration in seal performance are prevented at the power feeding portion for the heater element.

Another object of the present invention is to provide an electric heating arrangement of the above described type which is simple in structure and stable in functioning, and can be readily incorporated into microwave ovens of the above described kind at low cost.

In accomplishing these and other objects, in one preferred embodiment according to the present invention, the microwave oven is provided with en electric heating arrangement which includes a heater portion having a heater member surrounded by a sheath member and a power supplying base portion enclosed in a metallic cover member and having power supplying electrodes for said heater portion, and a power feeding section having a choke structure for preventing leakage of high frequency waves which is provided in one of walls defining a heating cavity so as to receive the power supplying base portion of the heater element in an opening formed in the choke structure, while the sheath member is so connected to the metallic cover member as to establish good electrical conduction therebetween, so that sealing of high frequency waves is achieved between the heater element and choke structure. Additionally, the power feeding section is further provided with a spacer member of insulating material for supporting the metallic cover member of the base portion in a position higher than and spaced from the bottom of the opening formed in the choke structure, with the spacer member having an opening smaller in width than the width of said opening of the choke structure and the width of a corresponding opening formed in the rear wall of the heating cavity, and thus generation of the undesirable spark discharge due to contact of the metallic cover member with the rear wall is advantageously prevented.

These and other objects and features of the present invention will become apparent from the following description taken in conjunction with the preferred embodiment thereof with reference to the accompanying drawings, in which:

FIG. 1 is a perspective view of a microwave oven in which the electric heating arrangement according to the present invention is incorporated, FIG. 2 is a side sectional view of the microwave oven of FIG. 1, FIG. 3 is a fragmentary sectional view, on an enlarged scale, of a heater portion of a heater element employed in the microwave oven of FIG. 1, FIG. 4 is a top plan view of the heater element for the electric heating arrangement employed in the microwave oven of FIG. 1, FIG. 5 is a longitudinal sectional view, on an enlarged scale, of a power supplying base portion of the heater element of FIG. 4, FIG. 6 is a side sectional view of the power supplying base portion of FIG. 5, FIG. 7 is a sectional view taken along the line VII—VII of FIG. 6, FIG. 8 is a sectional view taken along the line VIII—VIII of FIG. 6, and FIG. 9 is a sectional view showing, on an enlarged scale, a construction for attaching the base portion of the heater element of FIG. 4 to a wall of heating cavity of the microwave oven.

Before the description of the present invention proceeds, it is to be noted that like parts are designated by like reference numerals throughout several views of the accompanying drawings.

DETAILED DESCRIPTION OF THE INVENTION

Figure 1:
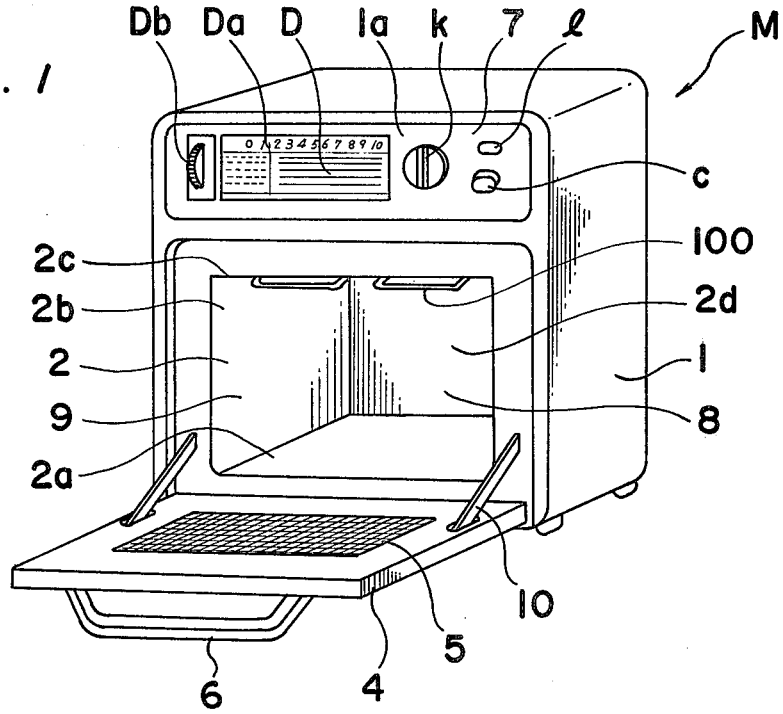
Figure 2:
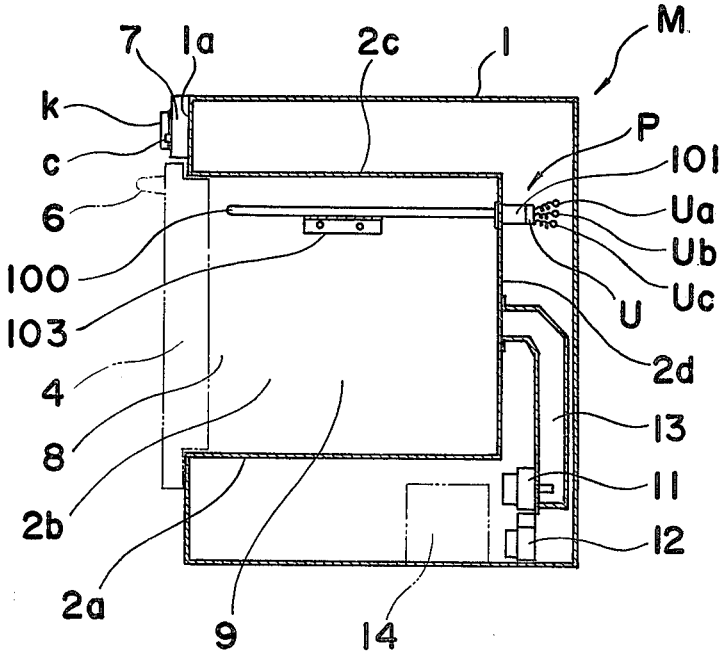
Figure 3:
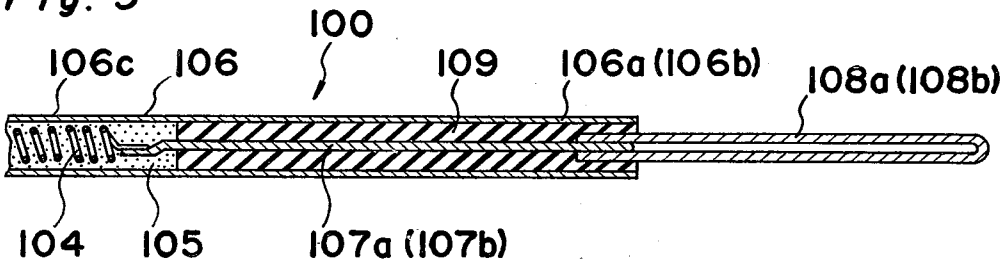
Figure 4:
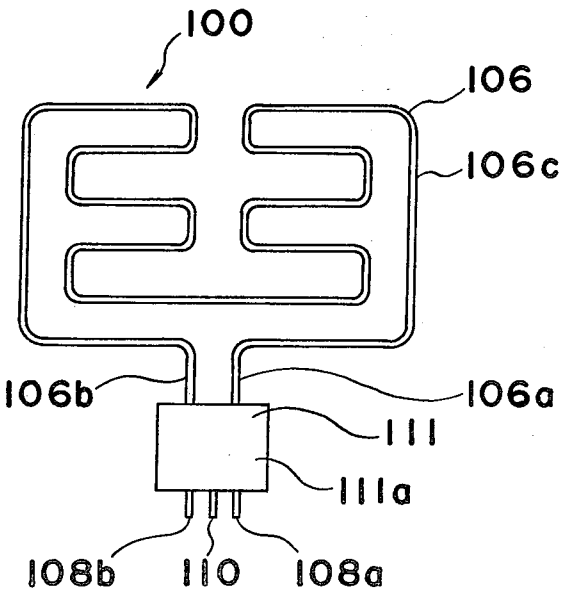

Referring now to the drawings, there is shown in FIGS. 1 and 2 a microwave oven M to which the present invention is applicable. The microwave oven M heat-treats objects or food material based on the principle of dielectric heating by utilizing high frequency energy, for example, on the order of about 2,450 MHz, and generally includes an outer casing 1 of cubical box-like shape open at the front side thereof. The outer casing 1 has a double wall structure with inner walls 2 which are suitably made, for example, of electrically conductive material and which define a heating cavity or heating chamber 9. The inner walls 2 include a horizontal bottom plate or base plate 2*a* on which food material to be cooked is placed, vertical side walls 2*b*, a top wall 2*c* and a rear wall 2*d*, and define an access opening 8 at the front of the oven M. In the heating cavity 9, at a position below and adjacent to the horizontal top wall 2*c*, there is releasably disposed, in a direction parallel to said top wall 2*c*, an electric heater element 100 for the electric heating arrangement directly related to the present invention and described more in detail later. The heater element 100 is further supported by a support member 103 (FIG. 2) disposed in the heating cavity 9 in a position below said heater element 100 and suitably connected, at opposite ends thereof, to the vertical side walls 2*b* of the inner walls 2 for simultaneously acting as a guide rail when the heater element 100 is to be detached from or attached to the microwave oven M. The outer surfaces of the walls 2*a*, 2*b*, 2*c* and 2*d* are spaced from the corresponding walls of the outer casing 1 for providing spaces therebetween. The outer casing 1 further includes an outside front wall portion 1*a* immediately above the opening 8. On the front wall portion 1*a*, there is mounted a control panel 7 for controlling the functioning of a high frequency oscillator and the electric heating arrangement, which panel 7 carries thereon, for example, a rotatable drum D having the heating time required for a plurality of menus imprinted on its peripheral surface, a pointer needle Da for the drum D, a drum rotating ring Db, a timer operating knob k, a function indication lamp l and a cooking start button C for initiating the high frequency heating and/or electric heating through suitable change-over means (not shown).

Further included in the microwave oven M is a door 4 provided with a handle 6 adjacent to one edge thereof remote from a hinge by which the door 4 is supported, at the lower edge thereof, on the lower front edge of the casing 1 in a position corresponding to the access opening 8 for pivotal upward and downward movements about the hinge so as to selectively open and close the opening 8. The door 4 is further supported by a pair of door arms 10 slidably accommodated in the casing 1 and has a rectangular observation window 5 formed therein to allow the object placed in the heating cavity 9 to be observed therethrough and also for preventing the high frequency energy from leaking out of the heating cavity 9 during operation of the microwave oven M.

In the space defined by the rear wall 2*d* of the inner walls 2 and the corresponding rear wall of the outer casing 1, there are disposed a magnetron assembly or high frequency oscillator 11 for radiating the high frequency energy into the heating cavity 9 through a waveguide 13 which is coupled to the high frequency oscillator 11 in a known manner, a fan motor 12 provided adjacent to the high frequency oscillator 11 for cooling the latter, and a choke structure 101 for preventing high frequency wave leakage secured to the rear wall 2*d* and connected to a receptacle U to form a power feeding section P for the heater element 100 for detachably receiving therein a power supplying base portion 111 of the heater member 100 in a manner described later, while a power transformer 14 for supplying high voltage to the high frequency oscillator 11 is provided in the space defined by the bottom plate 2*a* of the inner walls 2 and the corresponding bottom wall of the outer casing 1 in a position adjacent to said oscillator 11.

Figure 5:
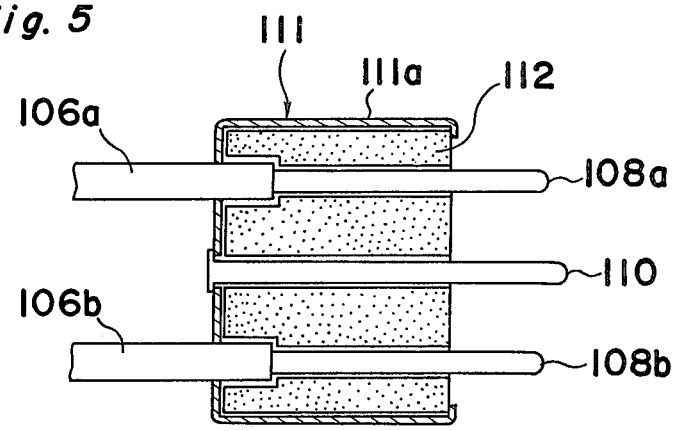
Figure 6:
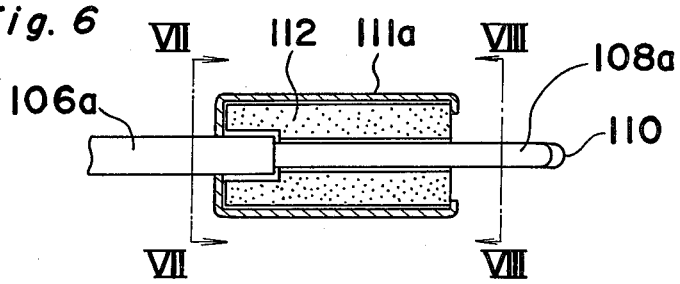
Figure 7:
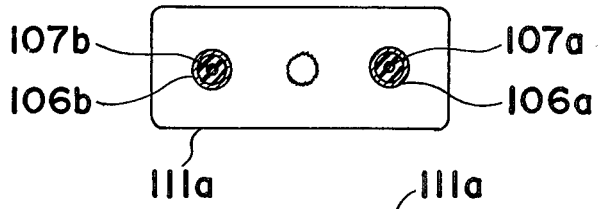
Figure 8:
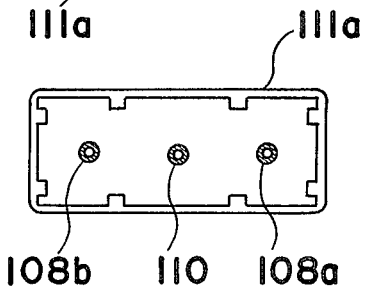

Referring particularly to FIGS. 3 through 8, the heater element 100 generally includes a heater portion 106 formed into a rectangular configuration and the power supplying base portion 111 to which opposite ends 106*a* and 106*b* of the heater portion 106 are coupled (FIG. 5). As is seen from FIG. 3, the heater portion 106 further includes a heater coil 104 of nichrome wire or the like accommodated, through insulating material 105 composed, for example, of particles of alumina, magnesia, etc., in a metallic outer tube or sheath 106*c*, preferably of stainless steel or the like having small magnetic permeability, first electrodes 107*a* and 107*b* respectively enclosed in the corresponding ends 106*a* and 106*b* of the sheath 106*c* through sealing insulation members 109 of glass, ceramic or the like and each connected at one end thereof to the corresponding end of the heater coil 104, with the other ends of the first electrodes 107*a* and 107*b* being connected to the corresponding ends of second electrodes 108*a* and 108*b* which extend outwardly to a certain extent from the ends 106*a* and 106*b* of the sheath 106*c* as shown. It should be noted here that the single metallic sheath 106*c* having the heating coil 104 enclosed therein through the insulating material 105 may further be divided into a plurality of sections for subsequent connection. On the other hand, the power supplying base portion 111 of the heater element 100 includes a metallic cover member 111*a* of a cubic box-like configuration in which the opposite ends 106*a* and 106*b* of the heater portion 106 are accommodated at the second electrodes 108*a* and 108*b* thereof, through a suitable insulating member 112 (FIG. 5), so that the second electrodes 108*a* and 108*b* extend to a certain extent from a corresponding side face of the base portion 111, while another electrode 110 for ground connection is also embedded in the insulating member 112 in a position between the second electrodes 108*a* and 108*b*, with one end of the electrode 110 being connected to the cover member 111*a* and the other end thereof extending, to a slightly larger extent than the ends of the second electrodes 108*a* and 108*b*, from the side face of the base portion 111 in a direction parallel to said second electrodes 108*a* and 108*b*.

It should be noted here that the arrangement according to the present invention as described above is characterized in causing the single metallic sheath 106*c*, or the plurality of such sheaths where there is a plurality of sections of the sheath, to have a potential common to the cover member 111*a*. For this purpose, the opposite ends 106*a* and 106*b* of the sheath 106*c* are rigidly connected to the cover member 111*a* through mechanical caulking or staking or through silver brazing or the like, while the grounding electrode 110 is also rigidly connected at the one end thereof to the metallic cover member 111*a* as described earlier. Furthermore, mechanical displacement of the electrodes 108*a*, 110 and 108*b* is advantageously prevented by the insulating member 112 enclosed in the cover member 111. In addition, the arrangement that the distance the grounding electrode 110 projects out of the one side face of the base portion 111 is made slightly larger than that of the second electrode 108*a* and 108*b* is effective for facilitating the positioning of the heater element 100 when the base portion 111 of the heater element 100 is to be inserted into the receptacle U, although this is not an essential feature of the present invention.

It should also be noted that the metallic cover member 111*a* described as having the rectangular box-like configuration may further be modified into any other shape having, for example, an elliptic or circular configuration in cross section.

Figure 9:
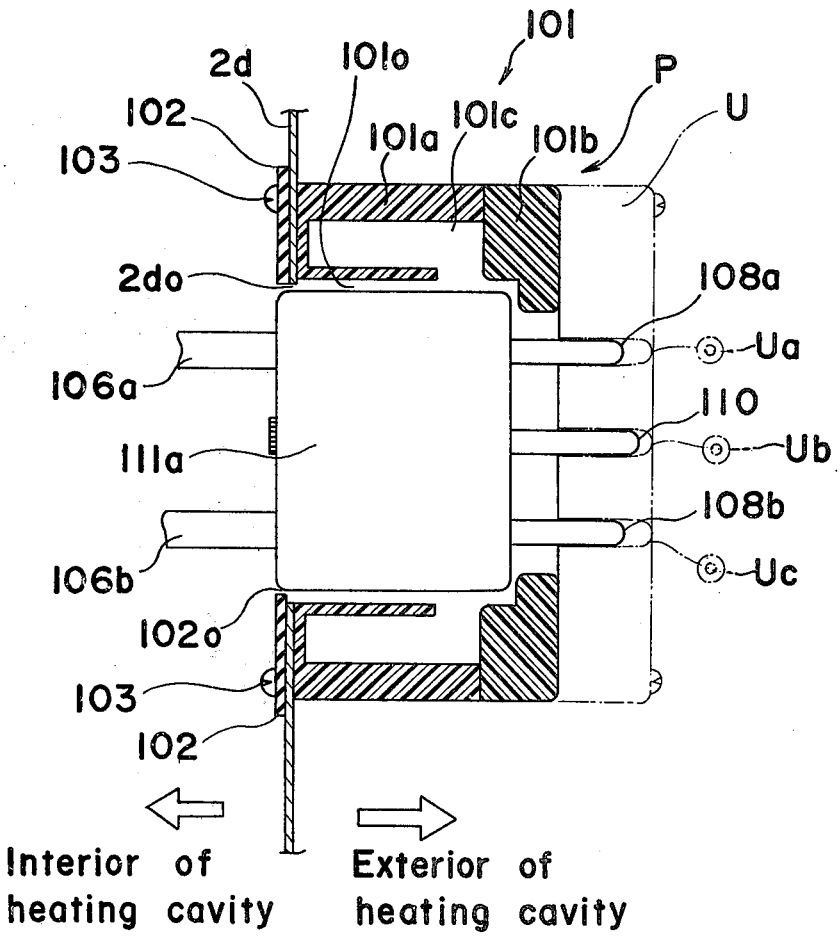

Referring particularly to FIG. 9, the choke structure 101 coupled with the receptacle U so as to form the power feeding section P for the heater element 100 and to prevent leakage of high frequency energy therefrom includes a first choke member 101*a* having an inlet opening 101*o* for receiving therein the power supplying base portion 111 of the heater element 100 and directly contacting, at one side face thereof, the outer surface of the rear wall 2*d* which has an opening 2*do* corresponding in position to the inlet opening 101*o*, and a second choke member 101*b* connected, at its one side face, to the other side face of the first choke member 101*a* to define a choke groove 101*c* between the first and second choke members 101*a* and 101*b*, while the receptacle U. having terminals Ua, Uc and Ub with lead wires (not shown) extending therefrom to receive the second electrodes 108*a* and 108*b* and the ground electrode 110 of the heater element 100 and having the lead wires connected to a suitable power supply circuit (not shown) is also attached to the other side face of the second choke member 101*b*, with the first and second choke members 101*a* and 101*b*, and the receptacle U being secured to the rear wall 2*d* of the heating cavity 9 by securing screws 103 through a spacer 102 of insulating material as shown. It should be noted here that the spacer 102 of insulating material is intended to hold said metallic cover member 111*a* of the base portion 111 in a position higher than and spaced from a bottom face of the inlet opening 101*o*, and has an opening 102*o* formed therein which is smaller in width and height than the width and height of the opening 2*do* in the rear wall 2*d* and the width and height of the inlet opening 101*o* of the first choke member 101*a* for preventing generation of spark discharge due to contact of the metallic cover member 111*a* with the rear wall 2*d* of the heating cavity 9 when the base portion 111 of the heater element 100 is inserted through the inlet opening 101*o* of the choke structure 101 into the receptacle U for connection of the electrodes 108*a*, 110 and 108*b* of the base portion 111 with the corresponding terminals U*a*, U*c* and U*b* of the receptacle U. Meanwhile, the high frequency waves which may leak through the space between the metallic cover member 111*a* and the choke structure 101 can further be reduced by setting the effective depth of the choke groove 101*c* close to one fourth of the wavelength of the oscillated high frequency waves. Additionally, although not shown in the drawing, means for detecting the presence of the base portion 111 of the heater element 100 in the choke structure 101 for preventing use of the microwave oven without attaching the heater element 100 thereto, or means for physically closing the opening 101*o* of the choke structure 101 in the absence of the heater element 100 may further be provided in the foregoing embodiment if needed.

It should also be noted that leakage of the high frequency waves out of the microwave oven can advantageously be reduced by setting the maximum width of the opening 101*o* less than half of the wavelength of the high frequency waves employed, even when the microwave oven is operated without inserting the heater element 100.

As is clear from the foregoing description, according to the arrangement of the present invention, the following favorable effects can be achieved.

(i) Since the heater element is readily detached from or attached to the microwave oven without requiring any special tool, the entire surface of the heating cavity wall can easily be cleaned in an efficient manner.

(ii) The construction in which the one or the plurality of the heater sheaths are a potential common to the metallic cover member electrically not only makes it possible to effect sealing of the high frequency waves by only one choke structure, with consequent simple construction, but prevents the danger arising from electric leakage by providing the grounding electrode, even when the insulation between the heater coil and the sheath has deteriorated due to abnormal rise of the heater temperature or soaking of the heater element end portions with water.

(iii) Since the choke structure is provided outside of the heating cavity, studies for making the electric field distribution uniform are facilitated from the designing point of view.

(iv) The insulating spacer provided on the rear wall of the heating cavity at the inlet opening of the choke structure eliminates the possibility of contact between the metallic cover member of the heater element and the choke members of the choke structure, and thus undesirable generation of spark discharge and reduction in sealing performance are advantageously prevented.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A microwave oven which comprises:

(a) an oven defining structure;

(b) a heating cavity defined by wall members within said oven defining structure and having an access opening at one side thereof; one of said wall members having a power feeding opening therein;

(c) a door member adapted to selectively open and close said access opening;

(d) means for supplying microwave energy into said heating cavity for dielectric heating of an object to be heated placed therein;

(e) electric heating means provided in said heating cavity for electrically heating the object to be heated in said heating cavity, said electric means having a heater element which includes a heater portion having heater member and a sheath means surrounding said heater member and a power supplying base portion having power supplying electrodes sealed therein connected to said heater portion and projecting out of said base portion; and a power feeding section mounted on said one of said wall members at said power feeding opening and having a recess therein for receiving, through said power feeding opening, said power supplying base portion of said heater element, said power feeding section having jacks therein for receiving said power supplying electrodes therein in electrical contact therewith, and a choke structure on said power feeding section extending around the power feeding opening and having a choke opening facing into said recess in spaced opposed relationship with the periphery of said power supplying base portion, whereby sealing of high frequency waves is achieved between said power supplying base portion and said choke structure.

2. A microwave oven as claimed in claim 1, wherein said choke member is disposed against the external surface of said one of said wall members with respect to said heating cavity.

3. A microwave oven as claimed in claim 1, wherein said power supplying base portion is enclosed in a metallic cover member which is electrically connected to said sheath means and which has a ground electrode projecting parallel to said power supplying electrodes and being electrically connected to said metallic cover member, said power feeding section having a ground jack therein receiving said ground electrode.

4. A microwave oven as claimed in claim 3, wherein said power feeding section has a spacer member of insulating material on said one wall for holding said metallic cover member in a position spaced from the edges of said opening and from said choke structure.

5. A microwave oven as claimed in claim 4, wherein said spacer member has an opening with smaller dimensions than said opening and said recess.

6. A microwave oven as claimed in claim 1, wherein said heater portion has insulating means between said metallic sheath means and said power supplying electrodes where they are connected to said heater member.

7. A microwave oven as claimed in claim 1, wherein said choke structure has first and second choke member defining said choke opening therebetween.

8. A microwave oven as claimed in claim 7, wherein the effective depth of said choke groove is close to one fourth of the wavelength of the high frequency waves from said microwave energy supply means.

9. A microwave oven as claimed in claim 1, wherein said opening formed in said choke structure is in its maximum width, less than one half of the wavelength of the high frequency waves from said microwave energy supply means.

10. A microwave oven as claimed in claim 1, wherein said electric heating arrangement further includes means for detecting presence of said heater element in said choke structure.

11. A microwave oven as claimed in claim 1, wherein said electric heating arrangement further includes means for closing said opening formed in said choke structure and facing said heating cavity when said heater element is not inserted in said opening of said choke structure.

* * * * *